US010875304B2

(12) United States Patent
Kakiuchi

(10) Patent No.: US 10,875,304 B2
(45) Date of Patent: Dec. 29, 2020

(54) LIQUID EJECTING HEAD INCLUDING SUBSTRATE AND RIGID LAYER HAVING CONVEX PARTS AND CONCAVE PARTS

(71) Applicant: BROTHER KOGYO KABUSHIKI KAISHA, Nagoya (JP)

(72) Inventor: Toru Kakiuchi, Aichi-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/540,186

(22) Filed: Aug. 14, 2019

(65) Prior Publication Data

US 2019/0366368 A1 Dec. 5, 2019

Related U.S. Application Data

(63) Continuation of application No. PCT/JP2018/010465, filed on Mar. 16, 2018.

(30) Foreign Application Priority Data

Mar. 29, 2017 (JP) ..... 2017-065671

(51) Int. Cl.
*B41J 2/14* (2006.01)
*B41J 2/16* (2006.01)

(52) U.S. Cl.
CPC ..... *B41J 2/14233* (2013.01); *B41J 2/1626* (2013.01); *B41J 2002/14266* (2013.01)

(58) Field of Classification Search
CPC ..... B41J 2/14233; B41J 2/14201
See application file for complete search history.

(56) References Cited

U.S. PATENT DOCUMENTS

2003/0030705 A1 2/2003 Koike et al.
2006/0012645 A1* 1/2006 Nagashima ..... B41J 2/14233 347/68

(Continued)

FOREIGN PATENT DOCUMENTS

EP 2623323 A1 8/2013
EP 2990206 A1 3/2016

(Continued)

OTHER PUBLICATIONS

International Preliminary Report on Patentability dated Oct. 1, 2019, together with the Written Opinion received in related International Application No. PCT/JP2018/010465.

(Continued)

*Primary Examiner* — Shelby L Fidler
(74) *Attorney, Agent, or Firm* — Scully, Scott, Murphy & Presser, PC

(57) ABSTRACT

A liquid ejecting head includes: a substrate; a first electrode; a piezoelectric layer covering the first electrode; a second electrode positioned on the piezoelectric layer; a plurality of pressure chambers arrayed in a first direction; and a rigid layer. Each pressure chamber has one end portion and another end portion in a second direction. The rigid layer has an edge providing a plurality of convex parts and a plurality of concave parts. Each convex part and each concave part are alternately arrayed with each other in the first direction. Each convex part is positioned outside each pressure chamber and protrudes in the second direction toward the another end portion. Each concave part is positioned at each pressure chamber and is concaved in the second direction away from the another end portion.

18 Claims, 11 Drawing Sheets

(56) References Cited

U.S. PATENT DOCUMENTS

| | | | | |
|---|---|---|---|---|
| 2011/0234704 | A1* | 9/2011 | Hahiro | H01L 41/332 347/68 |
| 2013/0194353 | A1* | 8/2013 | Hirai | B41J 2/045 347/71 |
| 2014/0043401 | A1* | 2/2014 | Torimoto | B41J 2/055 347/71 |
| 2014/0240405 | A1 | 8/2014 | Furuya et al. | |
| 2014/0267511 | A1 | 9/2014 | Yazaki et al. | |
| 2017/0096006 | A1* | 4/2017 | Nakayama | B41J 2/1629 |
| 2017/0144442 | A1* | 5/2017 | Tsukahara | B41J 2/14201 |
| 2019/0092013 | A1* | 3/2019 | Mizuno | B41J 2/14233 |

FOREIGN PATENT DOCUMENTS

| | | | |
|---|---|---|---|
| JP | 2013-158909 | A | 8/2013 |
| JP | 2014-172392 | A | 9/2014 |
| JP | 2016-049644 | A | 4/2016 |

OTHER PUBLICATIONS

Notification of First Office Action dated Jun. 11, 2020 received from the China National Intellectual Property Administration in related application CN 201880022203.7 together with English language translation.

International Search Report and Written Opinion dated Jun. 7, 2018 issued in PCT/JP2018/010465.

* cited by examiner

LIQUID EJECTING HEAD INCLUDING SUBSTRATE AND RIGID LAYER HAVING CONVEX PARTS AND CONCAVE PARTS

CROSS REFERENCE TO RELATED APPLICATION

This is a by-pass continuation application of International Application No. PCT/JP2018/010465 filed Mar. 16, 2018 claiming priority from Japanese Patent Application No. 2017-065671 filed Mar. 29, 2017. The entire contents of the International Application and the priority application are incorporated herein by reference.

TECHNICAL FIELD

The present disclosure relates to a liquid ejecting head that ejects liquid, such as ink.

BACKGROUND

A conventional liquid ejecting head provided with elongated pressure chambers in communication with nozzles, piezoelectric bodies formed above the corresponding pressure chambers, and lead electrodes disposed on the piezoelectric bodies on both longitudinal ends of the pressure chambers has been proposed (see Japanese Patent Application Publication No. 2013-158909, for example). The lead electrodes are formed of metal. Thus, the lead electrodes can reinforce the piezoelectric bodies.

The conventional liquid ejecting head is manufactured according to the following method, for example. The piezoelectric bodies and the lead electrodes are formed on a top surface of a silicon substrate according to a prescribed pattern, after which a bottom surface of the silicon substrate is etched to form the pressure chambers. The pressure chambers are formed with reference to the patterns formed on the top surface of the silicon substrate so that the piezoelectric bodies are disposed in the centers of corresponding pressure chambers. When the piezoelectric bodies are positioned in the centers of the corresponding pressure chambers, displacement produced by each piezoelectric body is greatest at the center of the corresponding pressure chamber. Consequently, a sufficient amount of liquid can be ejected through the corresponding nozzle.

SUMMARY

However, the etching process is difficult to perform with great precision since dimensions of the pressure chambers are very small. Consequently, the pressure chambers produced through the etching process may deviate from their desired positions such that the piezoelectric bodies are disposed in positions offset from the centers of the corresponding pressure chambers. In such a case, displacement generated by each piezoelectric body may be greatest at a position offset from the center of the pressure chamber and, hence, the quantity of liquid ejected from the corresponding nozzle may be insufficient.

In view of the foregoing, it is an object of the present disclosure to provide a liquid ejecting head capable of suppressing a loss in the quantity of liquid ejected from nozzles, even when corresponding pressure chambers deviate from their desired positions.

In order to attain the above and other object, according to one aspect, the disclosure provides a liquid ejecting head including: a substrate; a first electrode; a piezoelectric layer; a second electrode; a plurality of pressure chambers; and a rigid layer. The substrate has a first surface and a second surface opposite to the first surface. The substrate extends in a first direction parallel to the first surface and a second direction parallel to the first surface and intersecting the first direction. The first electrode is provided on the first surface of the substrate. The piezoelectric layer is provided on the first surface of the substrate to cover the first electrode. The second electrode is positioned on the piezoelectric layer. The plurality of pressure chambers is formed on the second surface of the substrate and arrayed in the first direction. Each of the plurality of pressure chambers has one end portion and another end portion in the second direction. The rigid layer is provided on the second electrode and extends in the first direction so as to be overlapped with the one end portion of each of the plurality of pressure chambers. The rigid layer has a nonlinear shaped edge providing a plurality of convex parts and a plurality of concave parts. Each of the plurality of convex parts and each of the plurality of concave parts are alternately arrayed with each other in the first direction. Each of the plurality of convex parts is positioned outside each of the plurality of pressure chambers and protrudes in the second direction toward the another end portion. Each of the plurality of concave parts is positioned at each of the plurality of pressure chambers and is concaved in the second direction away from the another end portion.

BRIEF DESCRIPTION OF THE DRAWINGS

FIG. 8(*a*) is a schematic plan view of the pressure chamber 21*a* in a target position; and FIG. 8(*b*) is a schematic plan view of the pressure chamber 21*a* in a position deviant from the target position;

DETAILED DESCRIPTION

First Embodiment

Figure 1:
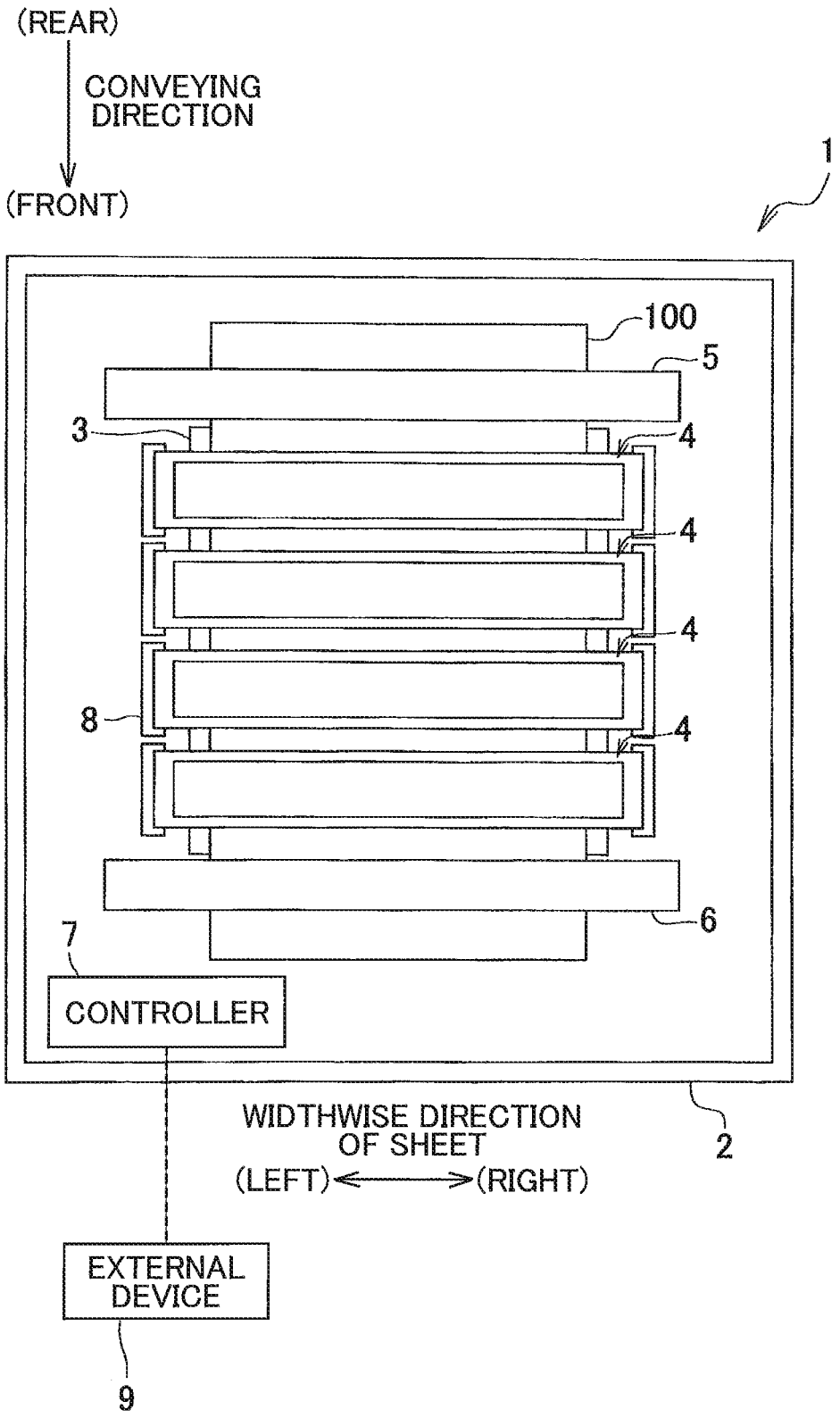
FIG. 1 is a schematic plan view of a printer 1 provided with a liquid ejecting head 11 according to a first embodiment of the present disclosure.

Next, a printer 1 provided with a liquid ejecting head 11 according to a first embodiment of the present disclosure will be described with reference to FIGS. 1 to 8. In FIG. 1, the side of the printer 1 that is downstream in a conveying direction of a recording sheet 100 will be defined as a front side, while the upstream side in the conveying direction will be defined as a rear side. That is, a front-rear direction relative to the printer 1 is parallel to the conveying direction. Further, a direction that is perpendicular to the conveying direction and that is parallel to a plane of the conveyed recording sheet 100 (a plane parallel to a sheet surface of FIG. 1) will be defined as a left-right direction relative to the printer 1. Here, the direction perpendicular to the conveying direction (i.e., the left-right direction) corresponds to the first direction, while the conveying direction (i.e., the front-rear direction) corresponds to the second direction. In addition, a direction perpendicular to the plane of the conveyed recording sheet 100 (a direction perpendicular to the sheet surface of FIG. 1) will be defined as an up-down direction relative to the printer 1. In the following description, front, rear, left, right, up, and down will be used as directional terms when appropriate.

As illustrated in FIG. 1, the printer 1 is provided with a casing 2, a platen 3, four inkjet heads 4, two conveying rollers 5 and 6, and a controller 7.

The platen 3 is horizontally mounted in the casing 2. When conveyed through the printer 1, the recording sheet 100 is supported on the top surface of the platen 3. The four inkjet heads 4 are arrayed in the front-rear direction at positions above the platen 3. The conveying roller 5 is positioned rearward of the platen 3, and the conveying roller 6 is positioned frontward of the platen 3. The conveying rollers 5 and 6 convey the recording sheet 100 frontward over the platen 3.

The controller 7 includes an FPGA (field programmable gate array), an ROM (read-only memory), an RAM (random access memory), and the like. The controller 7 is connected to an external device 9, such as a personal computer, and can perform data communications with the external device 9. The controller 7 controls components in the printer 1 on the basis of print data received from the external device 9. More specifically, the controller 7 controls the conveying rollers 5 and 6 to convey the recording sheet 100 in the conveying direction and controls the inkjet heads 4 to eject ink toward the recording sheet 100 while the recording sheet 100 is conveyed.

A plurality of head retaining units 8 is mounted in the casing 2. Each head retaining unit 8 holds one of the inkjet heads 4 at a position above the platen 3 and between the conveying rollers 5 and 6.

The four inkjet heads 4 eject ink in their respective four colors cyan (C), magenta (M), yellow (Y), and black (K). Ink of each color is supplied to the corresponding inkjet head 4 from an ink tank (not illustrated).

Figure 2:
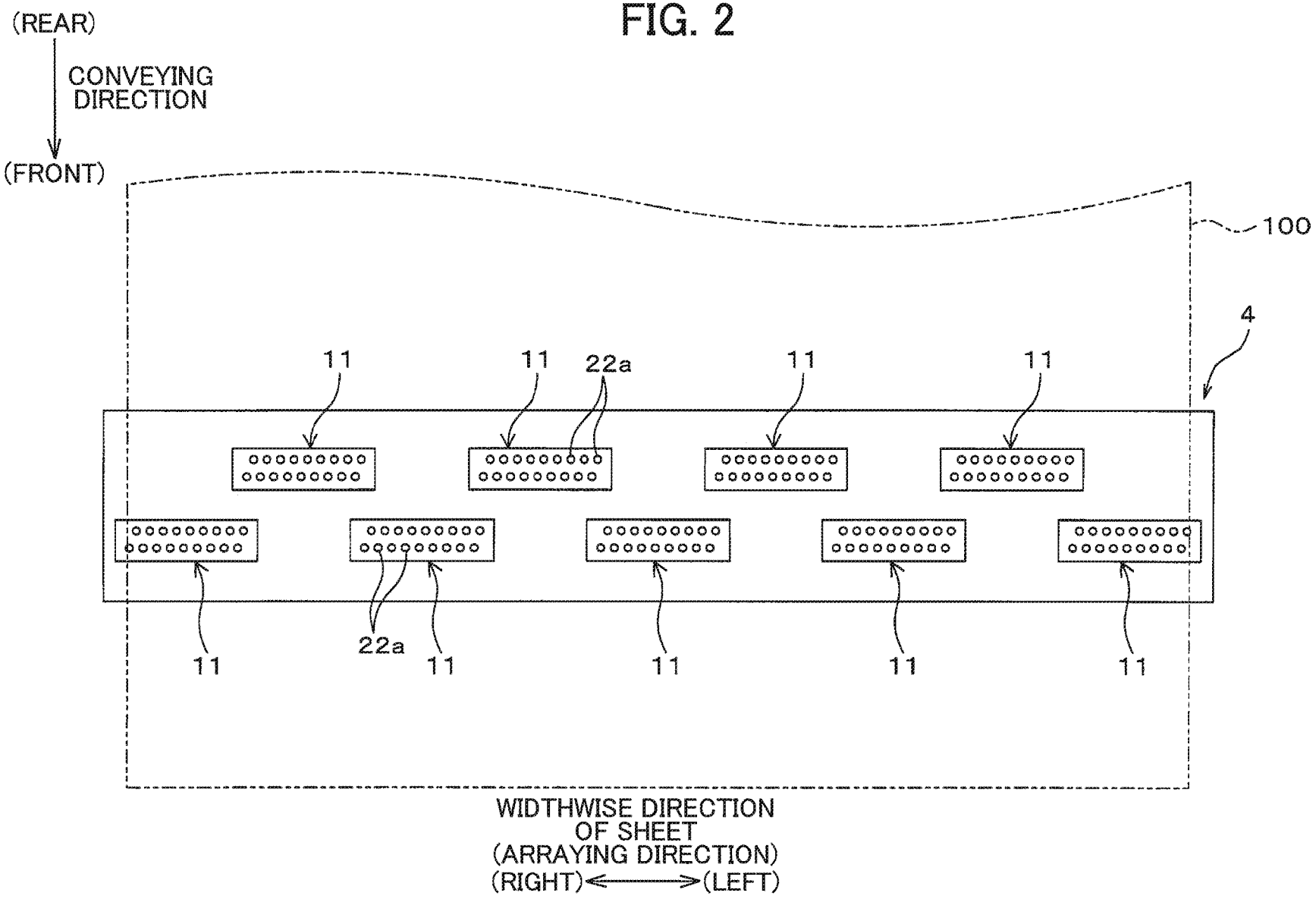
FIG. 2 is a bottom view of an inkjet head 4 in which the liquid ejecting head 11 according to the first embodiment is provided.
Figure 3:
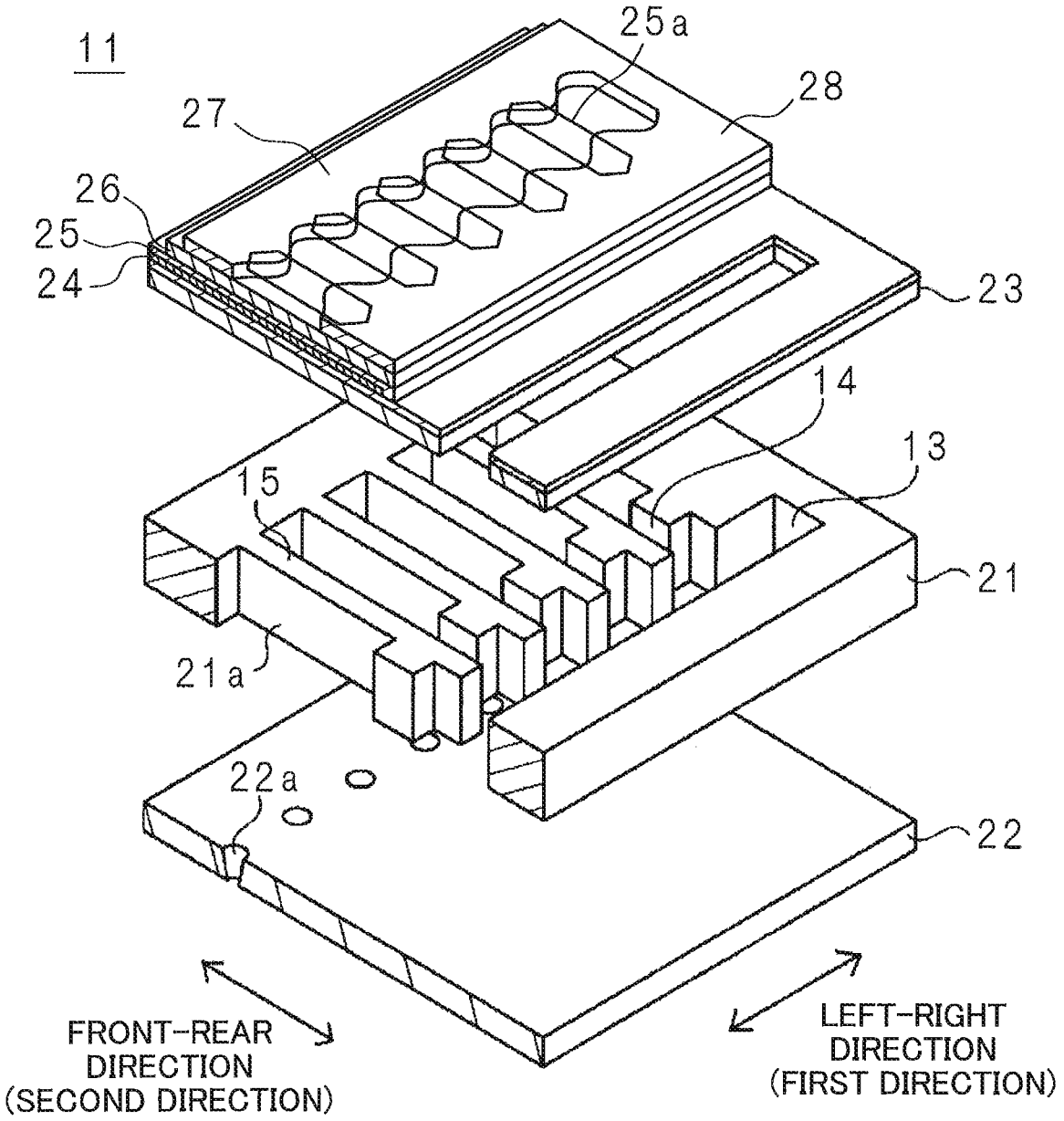
FIG. 3 is a schematic diagram of the liquid ejecting head 11 according to the first embodiment.

As illustrated in FIG. 2, each inkjet head 4 is provided with a plurality of liquid ejecting heads 11. The plurality of liquid ejecting heads 11 is provided at a lower portion of each inkjet head 4. A plurality of nozzles 22*a* is formed at a lower surface of each liquid ejecting head 11. In the following description, the left-right direction indicated in FIGS. 3 to 7 corresponds to the first direction in the disclosure, while the front-rear direction in the drawings corresponds to the second direction in the disclosure.

Each of the liquid ejecting heads 11 is provided with a support plate 21. The support plate 21 is configured of a single-crystal silicon substrate, for example, and an insulating film 23 is formed on the support plate 21. The insulating film 23 includes a first elastic film formed of an oxide film that is in contact with the support plate 21, and a second insulating film that is formed of an oxide film of a different material from the first elastic film and that is superimposed on the first elastic film. A plurality of spaces is formed in the support plate 21. Each of the spaces is elongated in the front-rear direction and penetrates the support plate 21 in the up-down direction. The spaces are arrayed in the left-right direction. The insulating film 23 (an example of a substrate) provided on an upper surface of the support plate 21 covers upper ends of the spaces formed in the support plate 21.

A nozzle plate 22 is provided at a lower surface of the support plate 21. The nozzle plate 22 covers lower ends of the spaces formed in the support plate 21. The nozzle plate 22 has the nozzles 22*a* that penetrate the nozzle plate 22 in the up-down direction. The nozzles 22*a* are arranged at positions beneath the corresponding spaces formed in the support plate 21. The support plate 21 also includes partitions 15 between neighboring spaces. The partitions 15, the insulating film 23, and the nozzle plate 22 constitute spaces serving as pressure chambers 21*a*. That is, the pressure chambers 21*a* are formed on a lower surface (an example of a second surface) of the insulating film 23.

The support plate 21 is formed with ink supply paths 14 provided at one longitudinal end of the pressure chambers 21*a* to communicate with the respective pressure chambers 21*a*. The ink supply paths 14 are separated by the partitions 15. A common liquid chamber 13 that communicates with each of the ink supply paths 14 is formed in the support plate 21 at a position outward of the ink supply paths 14 (i.e., a position opposite to the pressure chambers 21*a* with respect to the ink supply paths 14). The common liquid chamber 13 is an ink chamber (a liquid chamber) that is common to all of the pressure chambers 21*a* in the same liquid ejecting head 11. Each of the ink supply paths 14 has a cross-sectional area in the left-right direction smaller than that of each of the pressure chambers 21*a*, thereby maintaining a constant resistance of ink flowing from the common liquid chamber 13 into the pressure chambers 21*a*.

A plurality of lower electrodes 24 (an example of a first electrode) serving as individual electrodes is formed an upper surface (an example of a first surface) of the insulating film 23. The lower electrodes 24 are arrayed in the left-right direction at positions above the corresponding pressure chambers 21*a*. A piezoelectric layer 25 is formed over the entire upper surface of the insulating film 23 to cover the lower electrodes 24.

A plurality of slits 25*a* is formed in the piezoelectric layer 25 by removing a portion of the same. The slits 25*a* extend in the front-rear direction and are arrayed in the left-right direction. Each slit 25*a* is formed between two neighboring lower electrodes 24.

Figure 4:
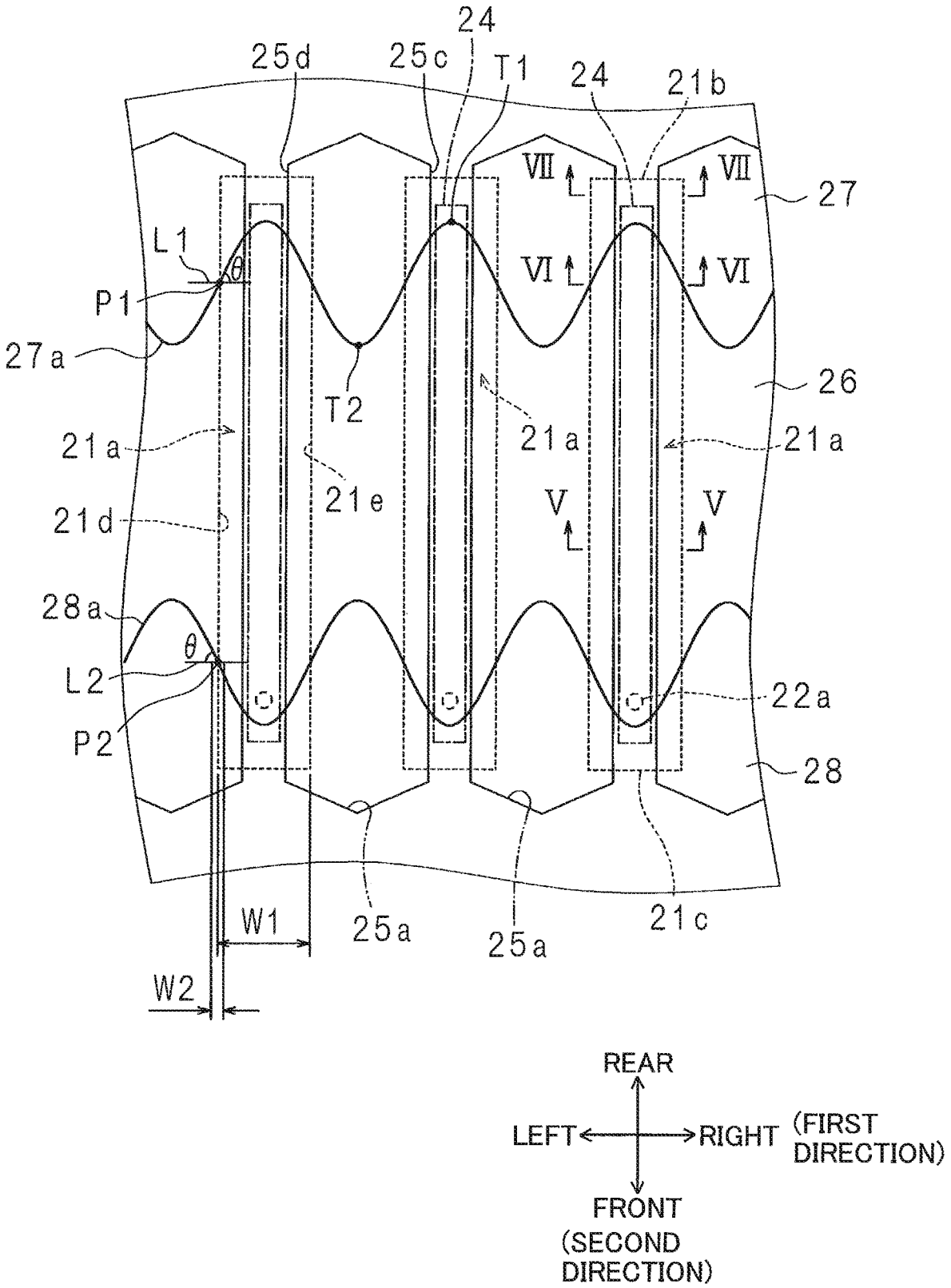
FIG. 4 is a schematic enlarged plan view illustrating a part of the main structure of the liquid ejecting head 11 according to the first embodiment.

As illustrated in FIG. 4, each slit 25*a* has a right edge 25*c* positioned above one pressure chamber 21*a*, and a left edge 25*d* positioned above another pressure chamber 21*a* positioned adjacent to and leftward of the one first pressure chamber 21*a*. In other words, the right edge 25*c* and the left edge 25*d* of each slit 25*a* are positioned inside the two neighboring pressure chambers 21*a* in the left-right direction in a plan view.

Figure 5:
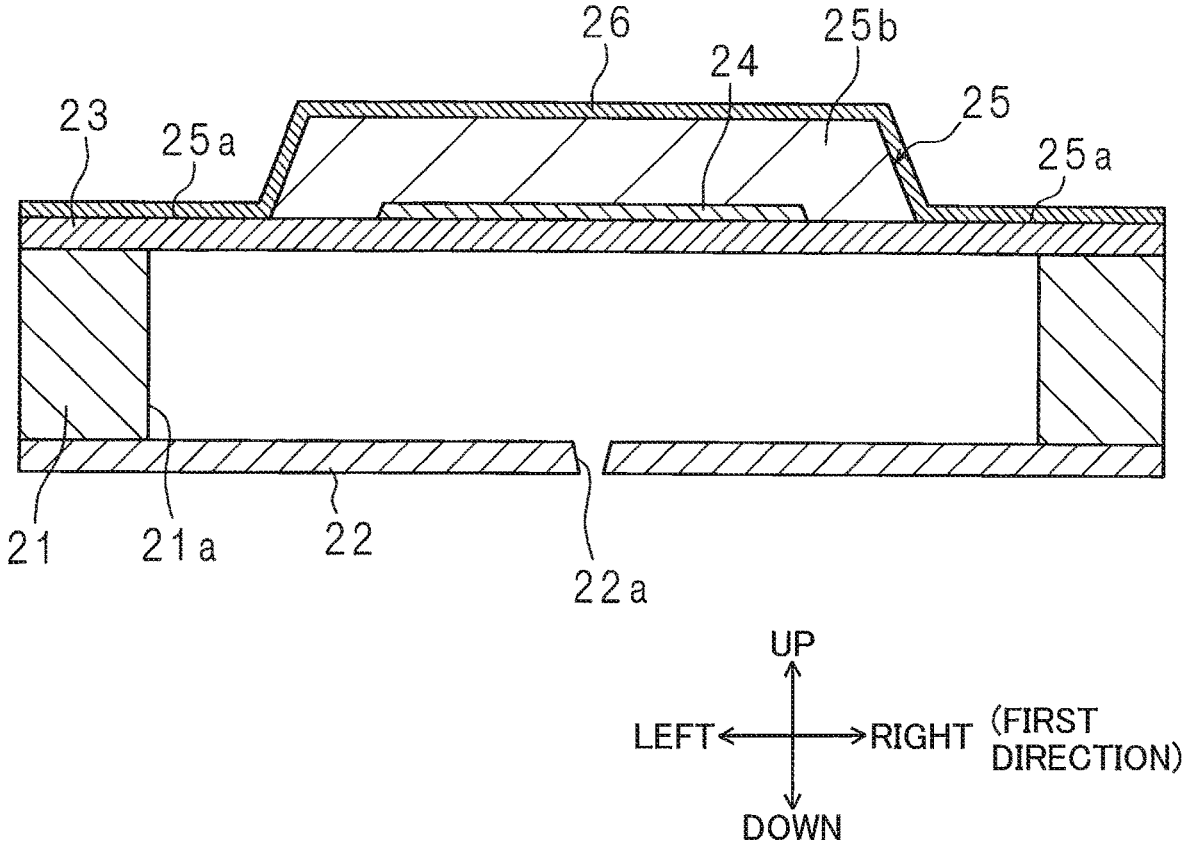
FIG. 5 is a schematic cross-sectional view of a pressure chamber 21*a* taken along a line V-V in FIG. 4.
Figure 6:
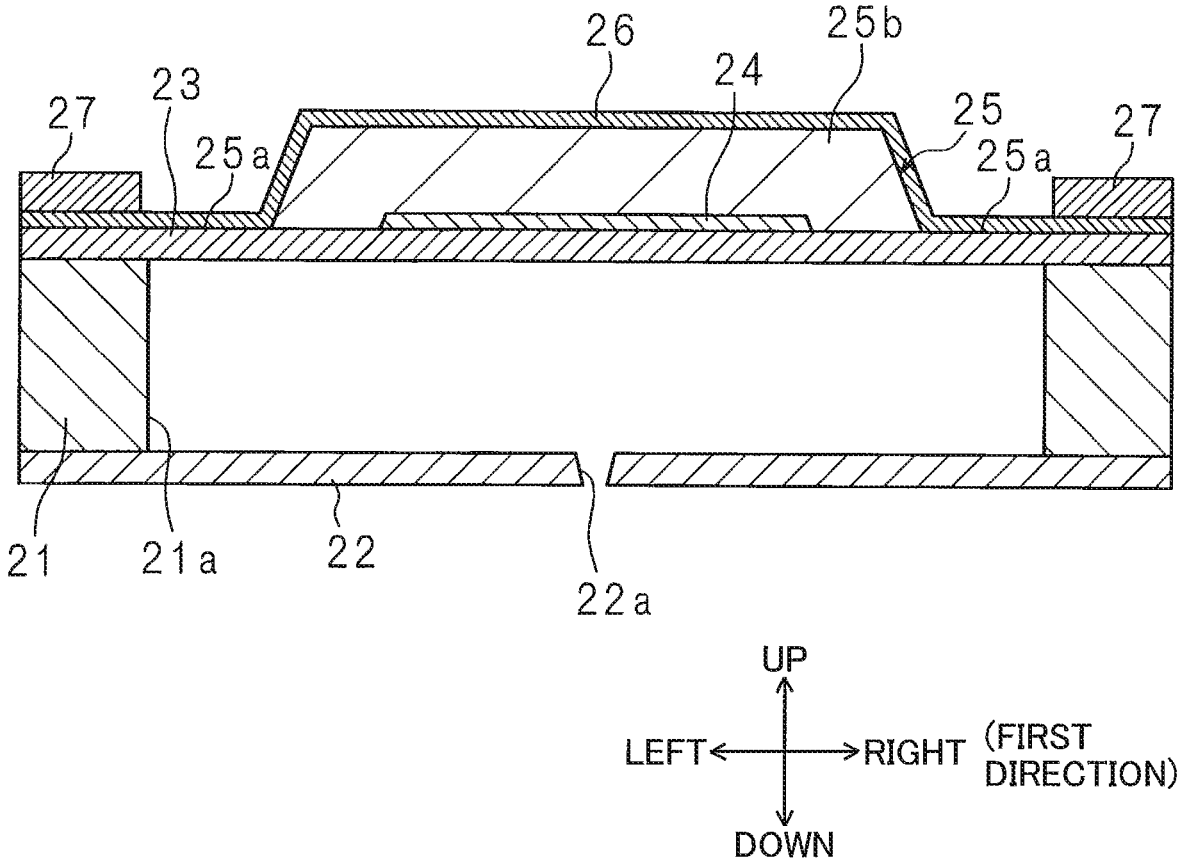
FIG. 6 is a schematic cross-sectional view of the pressure chamber 21*a* taken along a line VI-VI in FIG. 4.
Figure 7:
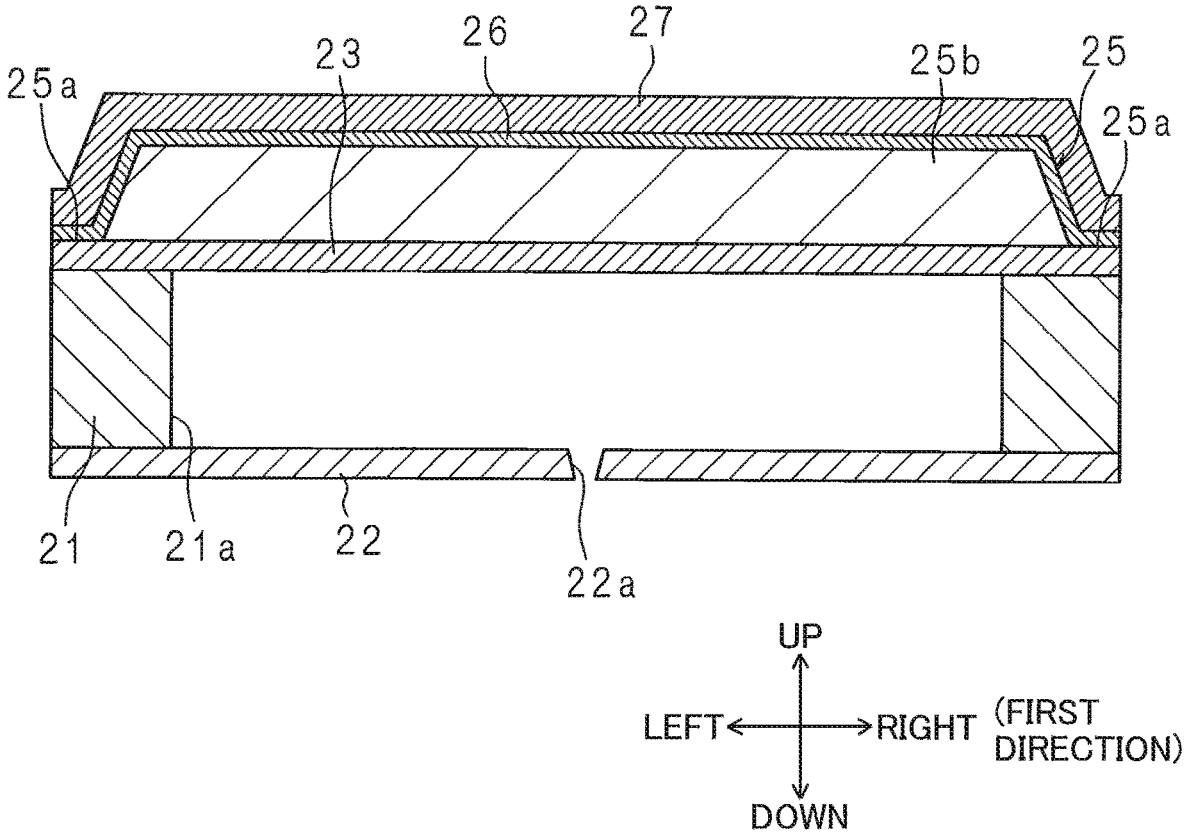
FIG. 7 is a schematic cross-sectional view of the pressure chamber 21*a* taken along a line VII-VII in FIG. 4.
Figure 8:
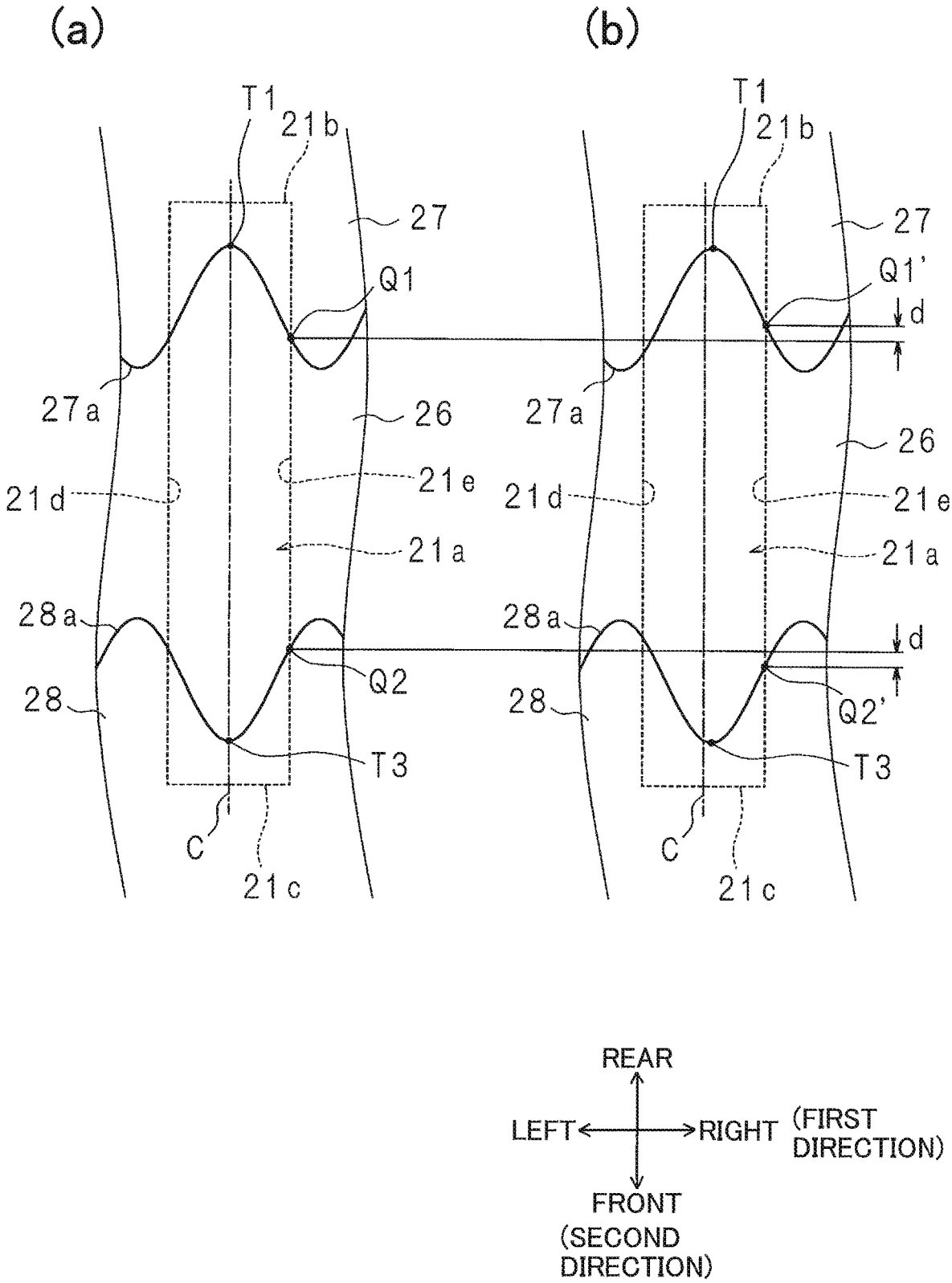
FIG. 8 is a schematic plan view of the pressure chamber 21*a* in the liquid ejecting head 11 according to the first embodiment.

Each portion of the piezoelectric layer 25 formed between two neighboring slits 25*a* constitutes a piezoelectric region 25*b* (see FIG. 5). Each piezoelectric region 25*b* covers the corresponding lower electrode 24. An upper electrode 26 (an example of a second electrode) serving as a common electrode is formed over an entire upper surface of the piezoelectric layer 25 and upper surfaces of the slits 25*a* (i.e., an upper surface of the insulating film 23 in each of the slits 25*a*), as illustrated in FIGS. 5 to 7. While the upper electrode 26 covers the slits 25*a*, the slits 25*a* are illustrated with solid lines in FIGS. 3 and 4 to clarify their positions.

A first rigid layer 27 (an example of a rigid layer) elongated in the left-right direction is formed at a position above the upper electrode 26 and rear edges 21*b* (an example of one end portion) of the pressure chambers 21*a*. The first rigid layer 27 is provided across the plurality of pressure chambers 21*a*. As illustrated in FIG. 4, the first rigid layer 27 has a front edge 27*a* (an example of an edge) shaped like a sine wave or a cosine wave, for example. In other words, the front edge 27*a* of the first rigid layer 27 has a nonlinear shape.

The wave shape of the front edge 27*a* includes first peaks T1 denoting points positioned rearmost in the front edge 27*a*, and second peaks T2 denoting points positioned frontmost in the front edge 27*a*. The first peaks T1 are positioned above the corresponding pressure chambers 21*a*, while the second peaks T2 are positioned above the corresponding slits 25*a*. Thus, the front edge 27*a* of the first rigid layer 27 extends toward front edges 21*c* (an example of another end portion) of the pressure chambers 21*a* with increasing a distance from a center in the left-right direction of each pressure chamber 21*a* toward an outside of each pressure chamber 21*a* in the left-right direction so as to gradually approach the front edges 21*c* of the pressure chambers 21*a*. That is, if a portion in the front edge 27*a* between one peak T1 and neighboring peak T2 positioned rightward of the peak T1 is defined, the portion of the front edge 27*a* gradually approaches the front edges 21*c* toward the outside of the corresponding pressure chamber 21*a* in the left-right direction (i.e., toward a right edge 21*e* of the pressure chamber 21*a*). Similarly, if another portion of the front edge 27*a* between one peak T1 and neighboring peak T2 positioned leftward of the peak T1 is defined, the other portion of the front edge 27*a* gradually approaches the front edges 21*c* toward the outside of the corresponding pressure chamber 21*a* in the left-right direction (i.e., toward a left edge 21*d* of the pressure chamber 21*a*).

In other words, the front edge 27*a* provides a plurality of convex parts and a plurality of concave parts, and each of the plurality of convex parts and each of the plurality of concave parts are alternately arrayed with each other in the left-right direction along the plurality of pressure chambers 21*a*. Each of the plurality of convex parts is positioned outside the corresponding pressure chamber 21*a* and protrudes toward the front edges 21*c*. On the other hand, each of the plurality of concave parts is positioned within the corresponding pressure chamber 21*a* and is concaved away from the front edges 21*c*.

As illustrated in FIG. 4, a width W1 denotes a dimension in the left-right direction of the pressure chamber 21*a*, and a width W2 denotes a range in the left-right direction whose center in the left-right direction is coincident with either the right edge 21*e* or the left edge 21*d* of the pressure chamber 21*a* (the left edge 21*d* in FIG. 4) such that W2=W1*0.10. That is, a range in the left-right direction positioned leftward of the left edge 21*d* or the right edge 21*e* in the width W2 has a width 5% of the width W1. Similarly, a range in the left-right direction positioned rightward of the left edge 21*d* or the right edge 21*e* in the width W2 has a width 5% of the width W1.

Here, the front edge 27*a* of the first rigid layer 27 intersects (overlaps) the right edge 21*e* or the left edge 21*d* of each of the pressure chambers 21*a* at a sloped portion thereof. This intersecting point P1 between the front edge 27*a* and the right edge 21*e* or the left edge 21*d* is positioned within the region in the width W2. More specifically, the front edge 27*a* of the first rigid layer 27 intersects (overlaps) the right edge 21*e* or the left edge 21*d* of each pressure chamber 21*a* within a region no more than 5% the width of the pressure chamber 21*a* that is positioned rightward or leftward of the right edge 21*e* or the left edge 21*d*. In other words, if the pressure chambers 21*a* are formed at positions deviant from their predetermined positions, the left edge 21*d* or the right edge 21*e* of each deviant pressure chamber 21*a* likely intersects the front edge 27*a* within a region of the width W2.

As described above, the right edge 25*c* of each slit 25*a* is overlapped with one pressure chamber 21*a*, and the left edge 25*d* of each slit 25*a* is overlapped with another pressure chamber 21*a* that neighbors and is positioned leftward of the one pressure chamber 21*a*. Thus, the front edge 27*a* of the first rigid layer 27 extends toward the front edge 21*c* of each pressure chamber 21*a* with increasing a distance from the right edge 25*c* of each slit 25*a* toward the left edge 21*d* of the neighboring pressure chamber 21*a*, and with increasing a distance from the left edge 25*d* of each slit 25*a* toward the right edge 21*e* of the neighboring pressure chamber 21*a* so as to gradually approach the front edge 21*c* of each pressure chamber 21*a*. The point at which the front edge 27*a* of the first rigid layer 27 intersects the right edge 21*e* or the left edge 21*d* of each pressure chamber 21*a* (i.e., the intersecting point P1) is overlapped with the corresponding slit 25*a*.

A second rigid layer 28 (an example of another rigid layer) elongated in the left-right direction is provided above the upper electrode 26 and the front edges 21*c* of the pressure chambers 21*a*. The second rigid layer 28 is provided across the plurality of pressure chambers 21*a*. As illustrated in FIG. 4, the second rigid layer 28 has a rear edge 28*a* (an example of another edge) shaped like a sine wave or a cosine wave, for example. The rear edge 28*a* has a shape that is approximately symmetrical to the front edge 27*a* in the front-rear direction. In other words, the rear edge 28*a* of the second rigid layer 28 also has a nonlinear shape. The rear edge 28*a* of the second rigid layer 28 extends toward the rear edges 21*b* of the pressure chambers 21*a* with increasing a distance from the center in the left-right direction of each pressure chamber 21*a* toward the outside of each pressure chamber 21*a* so as to gradually approach the front edges 21*c* of the pressure chambers 21*a*.

In other words, the rear edge 28*a* provides a plurality of convex parts and a plurality of concave parts, and each of the plurality of convex parts and each of the plurality of concave parts are alternately arrayed with each other in the left-right direction along the plurality of pressure chambers 21*a*. Each of the plurality of convex parts is positioned outside the corresponding pressure chamber 21*a* and protrudes toward the rear edges 21*b*. On the other hand, each of the plurality of concave parts is positioned within the corresponding pressure chamber 21*a* and is concaved away from the rear edges 21*b*.

The rear edge 28*a* of the second rigid layer 28 intersects (overlaps) the right edge 21*e* or the left edge 21*d* of each of the pressure chambers 21*a* at a sloped portion thereof. Similar to the first rigid layer 27, this intersecting point P2 between the rear edge 28*a* and the right edge 21*e* or the left edge 21*d* is positioned within the region in the width W2. More specifically, the rear edge 28*a* of the second rigid layer 28 intersects (overlaps) the right edge 21*e* or the left edge 21*d* of each pressure chamber 21*a* within the region no more than 5% the width of the pressure chamber 21*a* that is positioned rightward or leftward of the right edge 21*e* of the left edge 21*d*. In other words, if the pressure chambers 21*a* are formed at positions deviant from their predetermined positions, the left edge 21*d* or the right edge 21*e* of each deviant pressure chamber 21*a* likely intersects the rear edge 28*a* within a region of the width W2.

As illustrated in FIG. 4, the intersecting point P1 denotes the maximum or the minimum slope in a sloped portion of the front edge 27*a*. If a reference line L1 extending in the left-right direction passes through the intersecting point P1, then the front edge 27*a* of the first rigid layer 27 and the reference line L1 form an angle θ that is at least 45 degrees and no greater than 90 degrees.

Further, as illustrated in FIG. 4, as with the front edge 27*a* of the first rigid layer 27, the intersecting point P2 denotes the maximum or the minimum slope in the sloped portion of the rear edge 28*a*. If a reference line L2 extending in the left-right direction passes through the intersecting point P2, the rear edge 28*a* of the second rigid layer 28 and the reference line L2 also form the angle θ that is greater than or equal to 45 degrees and less than 90 degrees.

Further, the rear edge 28*a* of the second rigid layer 28 extends toward the rear edge 21*b* of the pressure chamber 21*a* with increasing a distance from the right edge 25*c* of each slit 25*a* toward the left edge 21*d* of the neighboring pressure chamber 21*a*, and with increasing a distance from the left edge 25*d* of each slit 25*a* toward the right edge 21*e* of the neighboring pressure chamber 21*a* so as to gradually approach the rear edges 21*b* of the pressure chambers 21*a*. The point at which the rear edge 28*a* of the second rigid layer 28 intersects the right edge 21*e* or the left edge 21*d* of each pressure chamber 21*a* (i.e., the intersecting point P2) is overlapped with the corresponding slit 25*a*.

When a voltage is cyclically applied across the upper electrode 26 and one of the lower electrodes 24, the corresponding piezoelectric region 25*b* deforms, causing the insulating film 23 to oscillate. Consequently, ink supplied in the pressure chambers 21*a* is subsequently ejected through the corresponding nozzle 22*a* by the oscillation of the insulating film 23.

The first rigid layer 27 and the second rigid layer 28 are both formed of a metallic material that includes gold, iridium, aluminum, or platinum, for example. The first rigid layer 27 and the second rigid layer 28 reinforce front and rear end portions of the piezoelectric regions 25*b*, respectively.

As illustrated in FIGS. 8A and 8B, the wave shape of the rear edge 28*a* includes peaks T3 that are positioned frontmost in the rear edge 28*a*. In FIG. 8A, a point Q1 denotes an intersecting point between the front edge 27*a* of the first rigid layer 27 and the right edge 21*e* of the pressure chamber 21*a* when the pressure chamber 21*a* is in the target position, and a point Q2 denotes an intersecting point between the rear edge 28*a* of the second rigid layer 28 and the right edge 21*e* of the pressure chamber 21*a* when the pressure chamber 21*a* is in the target position.

In FIG. 8B, a point Q1' denotes an intersecting point between the front edge 27*a* of the first rigid layer 27 and the right edge 21*e* of the pressure chamber 21*a* when the pressure chamber 21*a* is in a position offset from the target position, and a point Q2' denotes an intersecting point between the rear edge 28*a* of the second rigid layer 28 and the right edge 21*e* of the pressure chamber 21*a* when the pressure chamber 21*a* is in the position offset from the target position. Further, a centerline C denotes the center of the pressure chamber 21*a* in the left-right direction in each of FIGS. 8A and 8B.

When the pressure chamber 21*a* is in the target position, both peaks T1 and T3 are overlapped with the centerline C in the up-down direction. However, when the pressure chamber 21*a* deviates from the target position, the peaks T1 and T3 are offset from the centerline C. For example, if the pressure chamber 21*a* deviates to a position leftward of the target position as illustrated in FIG. 8B, the peaks T1 and T3 are offset to positions rightward relative to the centerline C.

As illustrated in FIGS. 8A and 8B, the intersecting point Q1' is positioned away from and rearward of the intersecting point Q1 by a distance d. The intersecting point Q1' is in a position closer to the rear edge 21*b* of the pressure chamber 21*a* than the intersecting point Q1 is to the rear edge 21*b*. That is, in the case illustrated in FIG. 8B, the front edge 27*a* near the right edge 21*e* of the pressure chamber 21*a* is positioned rearward relative to the front edge 27*a* near the right edge 21*e* in the case illustrated in FIG. 8A.

Here, displacement generated by each piezoelectric region 25*b* is greatest at the center in the left-right direction of the corresponding pressure chamber 21*a* when the pressure chambers 21*a* are in their target positions. That is, when the pressure chamber 21*a* deviates leftward of the target position, the displacement in the piezoelectric region 25*b* becomes greatest at a position near the right edge 21*e* of the pressure chamber 21*a*. Since the right edge 21*e* of the pressure chamber 21*a* in the deviant position intersects the front edge 27*a* at a position rearward of the right edge 21*e* of the pressure chamber 21*a* in the target position, an area of the first rigid layer 27 that overlaps the pressure chamber 21*a* near the right edge 21*e* of the pressure chamber 21*a* (i.e., near a position closer to a position where the displacement in the piezoelectric region 25*b* becomes greatest) is less and thus a magnitude of displacement in the piezoelectric region 25*b* near the right edge 21*e* of the pressure chamber 21*a* is greater than that when the pressure chamber 21*a* is disposed in the target position. Thus, this configuration can suppress reduction in the quantity of liquid ejected through the nozzles 22*a*.

Similarly, the intersecting point Q2' is positioned away from and frontward of the intersecting point Q2 by the distance d. The intersecting point Q2' is in a position closer to the front edge 21*c* of the pressure chamber 21*a* than the intersecting point Q2 to the front edge 21*c*. That is, in the case illustrated in FIG. 8B, the rear edge 28*a* of the second rigid layer 28 near the right edge 21*e* of the pressure chamber 21*a* is positioned frontward relative to the rear edge 28*a* in the case illustrated in FIG. 8A. Consequently, an area of the second rigid layer 28 that overlaps the pressure chamber 21*a* near the right edge 21*e* of the pressure chamber 21*a* (i.e., near a position closer to a position where the displacement in the piezoelectric region 25*b* becomes greatest) is less, and thus the magnitude of displacement in the piezoelectric region 25*b* near the right edge 21*e* of the pressure chamber 21*a* is greater than that when the pressure chamber 21*a* is disposed in the target position. Thus, this configuration can also suppress reduction in the quantity of liquid ejected through the nozzles 22*a*.

Further, the front edge 27*a* of the first rigid layer 27 extends toward the front edges 21*c* of the pressure chambers 21*a* with increasing a distance from the center in the left-right direction of the pressure chamber 21*a* toward the outside of the pressure chamber 21*a* so as to gradually approach the front edges 21*c* of the pressure chambers 21*a*. Similarly, the rear edge 28*a* of the second rigid layer 28 extends toward the rear edges 21*b* of the pressure chambers 21*a* with increasing a distance from the center in the left-right direction of the pressure chamber 21*a* toward the outside of the pressure chamber 21*a* so as to gradually approach the rear edges 21*b* of the pressure chambers 21*a*. Accordingly, this configuration can adjust changes in displacement in the piezoelectric regions 25*b* caused by positional deviation between the pressure chambers 21*a* and the piezoelectric regions 25*b*.

The front edge 27*a* of the first rigid layer 27 intersects the reference line L1 parallel to the left-right direction at an angle of 45 degrees or more. Similarly, the rear edge 28*a* of the second rigid layer 28 intersects the reference line L2 parallel to the left-right direction at an angle of 45 degrees or more. As this angle of intersection decreases, the area of the first rigid layer 27 or the second rigid layer 28 that overlaps the pressure chamber 21*a* increases. Thus, the area of the first rigid layer 27 or the second rigid layer 28 overlapping the pressure chamber 21*a* can be decreased by bringing this angle of intersection larger, thereby compensating for changes in displacement in the piezoelectric regions 25*b*.

If the pressure chambers 21*a* is positioned at a position offset from their target positions, the front edge 27*a* of the first rigid layer 27 and the rear edge 28*a* of the second rigid layer 28 intersect the right edge 21*e* or the left edge 21*d* of each pressure chamber 21*a* within a region 10% of the width of each pressure chamber 21*a* in the target position with respect to the left-right direction. Most deviation in the pressure chambers 21*a* is within 5% of the width of the pressure chamber 21*a* in the left-right direction relative to the pressure chambers 21*a* in their target positions. That is, a tolerable amount in displacement of the pressure chambers 21*a* in the left-right direction is plus or minus 5% of the width of the pressure chambers 21*a* in the left-right direction relative to the pressure chambers 21*a* in the target position. Thus, changes in displacement in the piezoelectric regions 25*b* can be easily compensated for by ensuring that the front edge 27*a* of the first rigid layer 27 and the rear edge 28*a* of the second rigid layer 28 intersect the pressure chamber 21*a* within a range of 5% the width of the pressure chamber 21*a* from the right edge 21*e* or the left edge 21*d* in the left-right direction.

Each pressure chamber 21*a* is formed at a position between two neighboring slits 25*a*. Since one slit 25*a* is disposed on both side of each pressure chamber 21*a* in the left-right direction, the piezoelectric regions 25*b* are more readily deformable. Hence, this configuration can more easily compensate for changes in displacement in the piezoelectric regions 25*b*.

Both intersecting points P1 and P2 at which the respective front edge 27*a* of the first rigid layer 27 and the rear edge 28*a* of the second rigid layer 28 intersect the left edge 21*d* or the right edge 21*e* of each pressure chamber 21*a* fall within the corresponding slits 25*a*. Each slit 25*a* is formed at a position above the insulating film 23 in the vicinity of the left edge 21*d* and the right edge 21*e* of the pressure chamber 21*a*. In other words, each piezoelectric layer 25 is not provided above the insulating film 23 in the vicinity of the left edge 21*d* and the right edge 21*e*. Further, there is greater displacement in the slits 25*a* where no piezoelectric layer 25 is present. Covering the slits 25*a* with the first rigid layer 27 and the second rigid layer 28 improves the displacement-enhancing effect over that when no rigid layer is provided. Hence, this arrangement can further adjust changes in displacement in the piezoelectric region 25*b*.

The front edge 27*a* of the first rigid layer 27 extends toward the front edges 21*c* of the pressure chambers 21*a* with increasing a distance from the right edge 25*c* of each slit 25*a* toward the left edge 21*d* of the neighboring pressure chamber 21*a* and with increasing a distance from the left edge 25*d* of each slit 25*a* toward the right edge 21*e* of the neighboring pressure chamber 21*a* so as to gradually approach the front edges 21*c* of the pressure chambers 21*a*. Similarly, the rear edge 28*a* of the second rigid layer 28 extends toward the rear edges 21*b* of the pressure chambers 21*a* with increasing a distance from the right edge 25*c* of each slit 25*a* toward the left edge 21*d* of the neighboring pressure chamber 21*a* and with increasing a distance from the left edge 25*d* of each slit 25*a* toward the right edge 21*e* of the neighboring pressure chamber 21*a* so as to gradually approach the rear edges 21*b* of the pressure chambers 21*a*. Accordingly, this configuration can compensate for changes in displacement of the piezoelectric regions 25*b* caused by positional deviation between the pressure chambers 21*a* and the piezoelectric regions 25*b*.

The first rigid layer 27 is formed at a position above the rear edges 21*b* of the pressure chambers 21*a*, while the second rigid layer 28 is formed at a position above the front edges 21*c* of the pressure chambers 21*a*. By forming a rigid layer over both edges in the front-rear direction of the pressure chambers 21*a*, changes in displacement in the piezoelectric regions 25*b* can further be compensated for.

Since the first rigid layer 27 and the second rigid layer 28 are both formed of a metallic material, these components can reduce resistance in the upper electrode 26. Further, when gold, iridium, aluminum, or platinum is used as the metallic material, the first rigid layer 27 and the second rigid layer 28 have less resistance and can easily be formed as thin films.

Alternatively, the first rigid layer 27 and the second rigid layer 28 may be made of material other than a metallic material, such as an electrically insulating material that includes SiN, $SiO_2$, or $Al_2O_3$. By using such materials, the first rigid layer 27 and the second rigid layer 28 can readily be formed as thin films while achieving high rigidity.

Second Embodiment

Figure 9:
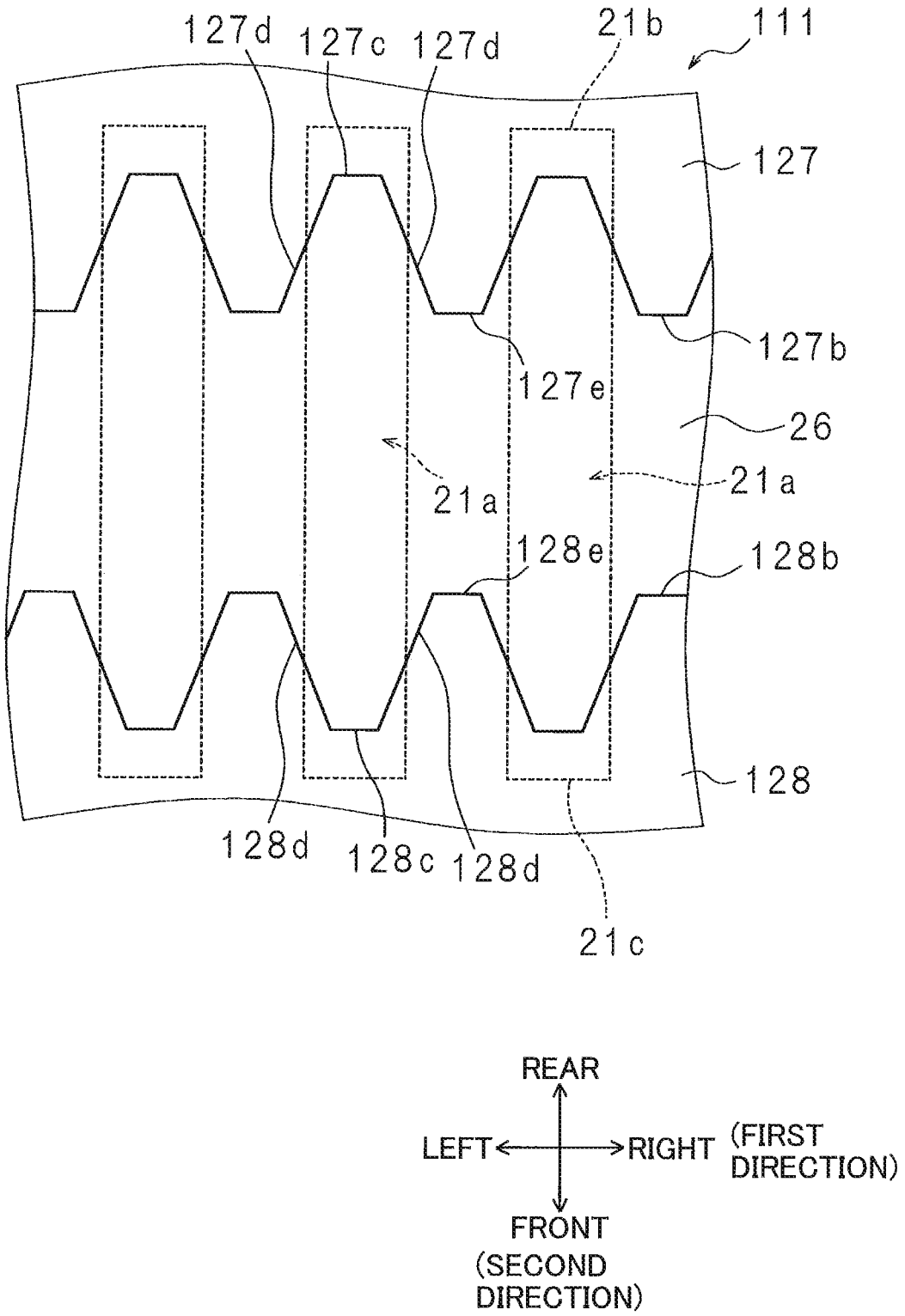
FIG. 9 is a schematic enlarged plan view illustrating a part of the main structure of a liquid ejecting head 111 according to a second embodiment of the present disclosure.

Next, a liquid ejecting head 111 according to a second embodiment of the present disclosure will be described with reference to FIG. 9. The liquid ejecting head 111 has a first rigid layer 127 and a second rigid layer 128. As illustrated in FIG. 9, the first rigid layer 127 has a front edge 127*b* in the shape of a trapezoidal wave, and the second rigid layer 128 has a rear edge 128*b* in the shape of a trapezoidal wave.

Specifically, the front edge 127*b* has first edge parts 127*c* extending in the left-right direction; second edge parts 127*d* that extend obliquely from both ends of the first edge parts 127*c* so as to gradually approach the front edges 21*c* of the pressure chambers 21*a* with increasing a distance from the center in the left-right direction of the pressure chamber 21*a* toward the outside in the left-right direction of the pressure chamber 21*a*; and third edge parts 127*e* extending in the left-right direction between the ends of two neighboring second edge parts 127*d* opposite to the ends connected to the first edge parts 127*c* at positions between neighboring pressure chambers 21*a*.

Similarly, the rear edge 128*b* has first edge parts 128*c* extending in the left-right direction; second edge parts 128*d* that extend obliquely from both ends of the first edge parts 128*c* so as to gradually approach the rear edge 21*b* of the pressure chamber 21*a* with increasing a distance from the center in the left-right direction of the pressure chamber 21*a* toward the outside in the left-right direction of the pressure chamber 21*a*; and third edge parts 128*e* extending in the left-right direction between the ends of two neighboring second edge parts 128*d* opposite to the ends connected to the first edge parts 128*c* at positions between neighboring pressure chambers 21*a*. The second embodiment obtains the same effects described in the first embodiment.

Note that parts and components in the second embodiment having the same structure as those in the first embodiment are designated with the same reference numerals to avoid duplicating description.

Modifications and Variations

While the description has been made in detail with reference to the embodiments thereof, it would be apparent to those skilled in the art that various changes and modifications may be made therein without departing from the scope of the above-described embodiments. Modifications and variations of the embodiments will next be described. The printer in the present disclosure is not limited to a line printer, but may be a serial printer that scans a print head in a direction intersecting the conveying direction. Further, the medium conveyed in the printer is not limited to the recording sheet 100, but may be any recordable medium (fabric, for example).

Figure 10:
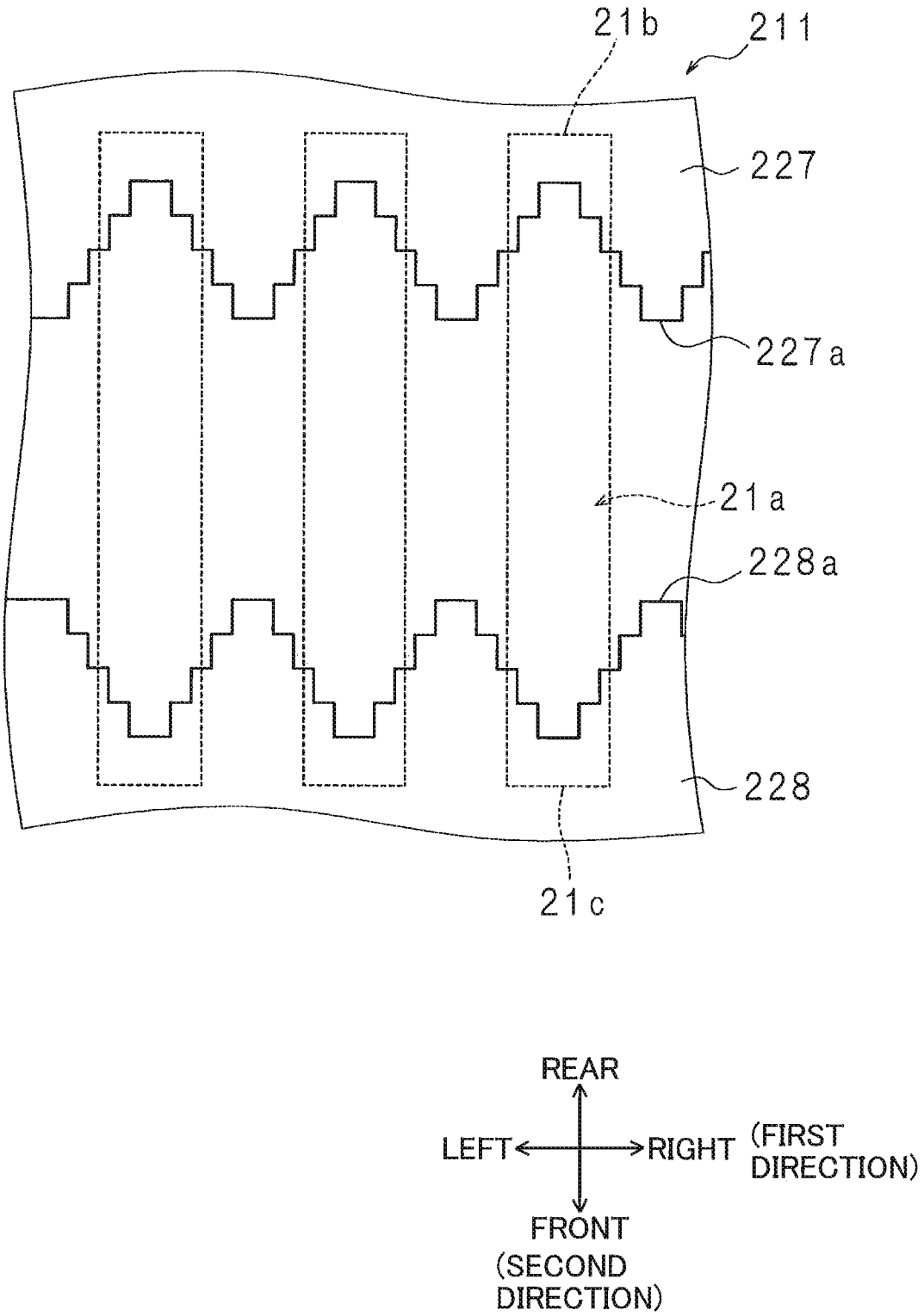
FIG. 10 is a schematic enlarged plan view illustrating a part of the main structure of a liquid ejecting head 211 according to a first modification.

The front edge 27*a* of the first rigid layer 27 need not be formed so as to gradually approach the front side of the pressure chamber 21*a* with increasing a distance from the center in the left-right direction to the outside in the left-right direction of the pressure chamber 21*a*. For example, the front edge of the first rigid layer may be formed in a stair shape so as to approach the front side of the pressure chamber 21*a* with increasing a distance from the center in the left-right direction to the outside in the left-right direction of the pressure chamber 21*a*, as illustrated in FIG. 10. FIG. 10 illustrates a liquid ejecting head 211 according to a first modification.

More specifically, the liquid ejecting head 211 has a first rigid layer 227, and a second rigid layer 228. The first rigid layer 227 has a front edge 227*a* that is formed to approach the front edges 21*c* by alternately combining edges extending frontward and edges extending rightward or leftward with increasing a distance from the center in the left-right direction of the pressure chamber 21*a* toward the outside of the pressure chamber 21*a* in the left-right direction. Similarly, the second rigid layer 228 has a rear edge 228*a* that is formed to approach the rear edges 21*b* by alternately combining edges extending rearward and edges extending rightward or leftward with increasing a distance from the center in the left-right direction of the pressure chamber 21*a* toward the outside of the pressure chamber 21*a* in the left-right direction.

Figure 11:
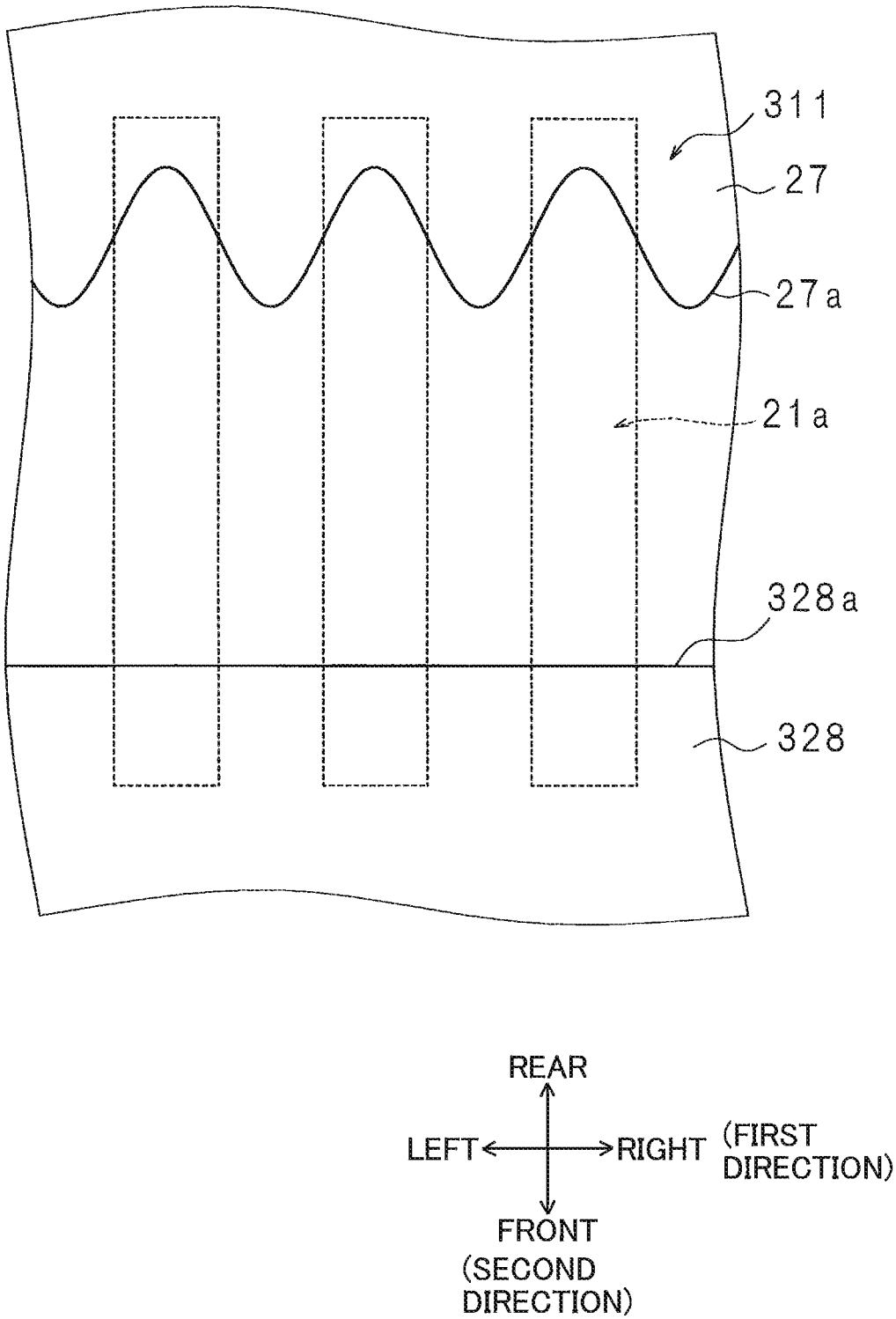
FIG. 11 is a schematic enlarged plan view illustrating a part of the main structure of a liquid ejecting head 311 according to a second modification.

While rigid layers (the first rigid layer 27 and the second rigid layer 28) having configurations to compensate for changes in displacement in the piezoelectric regions 25*b* are formed respectively on both the front edge and the rear edge of the pressure chambers 21*a* in the above-described embodiments, a rigid layer having such configuration may be provided on just one of the front edge and the rear edge, as illustrated in FIG. 11. FIG. 11 illustrates a liquid ejecting head 311 according to a second modification.

The liquid ejecting head 311 has the first rigid layer 27 described in the first embodiment. The front edge 27*a* is formed in the same shape described in the first embodiment so as to approach the front edges of the pressure chambers 21*a* with increasing a distance from the center in the left-right direction of the pressure chamber 21*a* toward the outside in the left-right direction of the pressure chamber 21*a*. The liquid ejecting head 311 also has a second rigid layer 328. The second rigid layer 328 has a rear edge 328*a* that extends linearly in the left-right direction. Accordingly, the rear edge 328*a* cannot compensate for changes in displacement of the piezoelectric regions caused by positional deviations. In the case that compensation for displacement caused by the positional deviation does not become too great, the compensation pattern for the positional deviation takes on the form of the front edge 27*a* alone.

While the lower electrodes are individual electrodes and the upper electrode is a common electrode in the above-described embodiments, a single lower electrode may be provided as a common electrode and a plurality of upper electrodes may be provided as individual electrodes. In this case, the first rigid layer 27 and the second rigid layer 28 are preferably formed of an electrically insulating material to prevent short-circuiting in the upper electrodes, which constitute the individual electrodes. If an insulating layer is formed between the first and second rigid layers 27, 28 and the upper electrodes serving as the individual electrodes, the first rigid layer 27 and the second rigid layer 28 may be formed of a metallic material since the insulating layer can prevent the individual electrodes from short-circuiting.

All embodiments described above are merely examples in all aspects and should not be considered to be limiting. The technical features described in each embodiment may be combined with each other, and the scope of the present disclosure is intended to encompass all modifications within the scope of the claims and a scope equivalent to the scope of the claims.

The present disclosure exemplified in the embodiments, modification and examples described above may be summarized as follows.

(1) According to one aspect, the disclosure provides a liquid ejecting head including: a substrate; a first electrode; a piezoelectric layer; a second electrode; a plurality of pressure chambers; and a rigid layer. The substrate has a first surface and a second surface opposite to the first surface. The substrate extends in a first direction parallel to the first surface and a second direction parallel to the first surface and intersecting the first direction. The first electrode is provided on the first surface of the substrate. The piezoelectric layer is provided on the first surface of the substrate to cover the first electrode. The second electrode is positioned on the piezoelectric layer. The plurality of pressure chambers is formed on the second surface of the substrate and arrayed in the first direction. Each of the plurality of pressure chambers has one end portion and another end portion in the second direction. The rigid layer is provided on the second electrode and extends in the first direction so as to be overlapped with the one end portion of each of the plurality of pressure chambers. The rigid layer has a nonlinear shaped edge providing a plurality of convex parts and a plurality of concave parts. Each of the plurality of convex parts and each of the plurality of concave parts are alternately arrayed with each other in the first direction. Each of the plurality of convex parts is positioned outside each of the plurality of pressure chambers and protrudes in the second direction toward the another end portion. Each of the plurality of concave parts is positioned at each of the plurality of pressure chambers and is concaved in the second direction away from the another end portion.

(2) In the liquid ejecting head according to the aspect (1), preferably, the edge gradually approaches the another end portion in the second direction of each of the plurality of pressure chambers with increasing a distance from each of the plurality of pressure chambers in the first direction.

(3) In the liquid ejecting head according to the aspect (1) or (2), preferably, the edge intersects a reference line extending in the first direction to form an angle of intersection not less than 45 degrees.

(4) In the liquid ejecting head according to the aspect (2) or (3), it is preferable that: each of the plurality of pressure chambers has a width in the first direction; and a tolerable displacement amount of each of the plurality of pressure chambers in the first direction relative to the substrate is plus or minus 5% of the width in the first direction of each of the plurality of pressure chambers with respect to an accurate position of each of the plurality of pressure chambers.

(5) In the liquid ejecting head according to any one of the aspects (2) to (4), preferably, the edge has a sine wave shape.

(6) In the liquid ejecting head according to any one of the aspects (2) to (4), preferably, the edge has a trapezoidal shape.

(7) In the liquid ejecting head according to the aspect (6), preferably, the edge includes a first edge part and a pair of second edge parts, the first edge part being overlapped with each of the plurality of pressure chambers and extending in the first direction, each of the pair of second edge parts extending from each end in the first direction of the first edge part such that each of the pair of second edge parts gradually approaches the another end portion in the second direction of each of the plurality of pressure chambers with increasing a distance from each of the plurality of pressure chambers in the first direction.

(8) In the liquid ejecting head according to any one of the aspects (1) to (7), it is preferable that: the piezoelectric layer is formed with a plurality of slits arrayed in the first direction; and each of the plurality of pressure chambers is positioned between neighboring slits of the plurality of slits.

(9) In the liquid ejecting head according to the aspect (8), preferably, an intersecting point between the edge of the rigid layer and an end of each of the plurality of pressure chambers is overlapped with each of the plurality of slits.

(10) In the liquid ejecting head according to the aspect (8) or (9), preferably, the edge gradually approaches the another end portion of each of the plurality of pressure chambers with increasing a distance from an edge of each of the plurality of slits toward neighboring end of each of the plurality of pressure chambers in the first direction.

(11) Preferably, the liquid ejecting head according to any one of the aspects (1) to (10) further includes another rigid layer provided on the second electrode and extending in the first direction so as to be overlapped with the another end portion of each of the plurality of pressure chambers.

(12) In the liquid ejecting head according to the aspect (11), preferably, the another rigid layer has another nonlinear shaped edge providing another plurality of convex parts and another plurality of concave parts, each of the another plurality of convex parts and each of the another plurality of concave parts being alternately arrayed with each other in the first direction, each of the another plurality of convex parts being positioned outside each of the plurality of pressure chambers and protruding in the second direction toward the one end portion, each of the another plurality of concave parts being positioned at each of the plurality of pressure chambers and concaved in the second direction away from the one end portion.

(13) In the liquid ejecting head according to the aspect (11), preferably, the another rigid layer has another edge having a linear shape extending in the first direction.

(14) In the liquid ejecting head according to the aspect (11), preferably, the rigid layer and the another rigid layer are made of metal.

(15) In the liquid ejecting head according to the aspect (14), preferably, the metal is selected from the group consisting of gold, iridium, aluminum, and platinum.

(16) In the liquid ejecting head according to the aspect (11), preferably, the rigid layer and the another rigid layer are made of electrically insulating material.

(17) In the liquid ejecting head according to the aspect (16), preferably, the electrically insulating material is selected from the group consisting of SiN, $SiO_2$ and $Al_2O_3$.

(18) In the liquid ejecting head according to any one of the aspects (1) to (17), it is preferable that: the first electrode is an individual electrode; and the second electrode is a common electrode.

In the liquid ejecting head according to the present disclosure, when the pressure chamber deviates from its desired position, an intersection point between the end of the pressure chamber and the edge of the rigid layer is positioned closer to the one end portion in the first direction of the pressure chamber than that when the pressure chamber is in its desired position is to the one end portion in the first direction of the pressure chamber. Accordingly, an area of the rigid layer that overlaps the pressure chamber near the end of the pressure chamber is less and thus a magnitude of displacement in the piezoelectric layer near the end of the pressure chamber is greater than that when the pressure chamber is in the desired position. This configuration can suppress reduction in the quantity of ejected liquid.

What is claimed is:

1. A liquid ejecting head comprising:

a substrate having a first surface and a second surface opposite to the first surface, the substrate extending in a first direction parallel to the first surface and a second direction parallel to the first surface and intersecting the first direction;

a first electrode provided on the first surface of the substrate;

a piezoelectric layer provided on the first surface of the substrate to cover the first electrode;

a second electrode positioned on the piezoelectric layer;

a plurality of pressure chambers formed on the second surface of the substrate and arrayed in the first direction, each of the plurality of pressure chambers having one end portion and another end portion in the second direction; and a rigid layer provided on the second electrode and extending in the first direction so as to be overlapped with the one end portion of each of the plurality of pressure chambers, the rigid layer having a nonlinear shaped edge providing a plurality of convex parts and a plurality of concave parts, each of the plurality of convex parts and each of the plurality of concave parts being alternately arrayed with each other in the first direction, each of the plurality of convex parts being positioned outside each of the plurality of pressure chambers and protruding in the second direction toward the another end portion, each of the plurality of concave parts being positioned at each of the plurality of pressure chambers and concaved in the second direction away from the another end portion.

2. The liquid ejecting head according to claim 1, wherein the edge gradually approaches the another end portion in the second direction of each of the plurality of pressure chambers with increasing a distance from each of the plurality of pressure chambers in the first direction.

3. The liquid ejecting head according to claim 1, wherein the edge intersects a reference line extending in the first direction to form an angle of intersection not less than 45 degrees.

4. The liquid ejecting head according to claim 2, wherein each of the plurality of pressure chambers has a width in the first direction, and wherein a tolerable displacement amount of each of the plurality of pressure chambers in the first direction relative to the substrate is plus or minus 5% of the width in the first direction of each of the plurality of pressure chambers with respect to an accurate position of each of the plurality of pressure chambers.

5. The liquid ejecting head according to claim 2, wherein the edge has a sine wave shape.

6. The liquid ejecting head according to claim 2, wherein the edge has a trapezoidal shape.

7. The liquid ejecting head according to claim 6, wherein the edge includes a first edge part and a pair of second edge parts, the first edge part being overlapped with each of the plurality of pressure chambers and extending in the first direction, each of the pair of second edge parts extending from each end in the first direction of the first edge part such that each of the pair of second edge parts gradually approaches the another end portion in the second direction of each of the plurality of pressure chambers with increasing a distance from each of the plurality of pressure chambers in the first direction.

8. The liquid ejecting head according to claim 1, wherein the piezoelectric layer is formed with a plurality of slits arrayed in the first direction, and wherein each of the plurality of pressure chambers is positioned between neighboring slits of the plurality of slits.

9. The liquid ejecting head according to claim 8, wherein an intersecting point between the edge of the rigid layer and an end of each of the plurality of pressure chambers is overlapped with each of the plurality of slits.

10. The liquid ejecting head according to claim 8, wherein the edge gradually approaches the another end portion of each of the plurality of pressure chambers with increasing a distance from an edge of each of the plurality of slits toward neighboring end of each of the plurality of pressure chambers in the first direction.

11. The liquid ejecting head according to claim 1, further comprising another rigid layer provided on the second electrode and extending in the first direction so as to be overlapped with the another end portion of each of the plurality of pressure chambers.

12. The liquid ejecting head according to claim 11, wherein the another rigid layer has another nonlinear shaped edge providing another plurality of convex parts and another plurality of concave parts, each of the another plurality of convex parts and each of the another plurality of concave parts being alternately arrayed with each other in the first direction, each of the another plurality of convex parts being positioned outside each of the plurality of pressure chambers and protruding in the second direction toward the one end portion, each of the another plurality of concave parts being positioned at each of the plurality of pressure chambers and concaved in the second direction away from the one end portion.

13. The liquid ejecting head according to claim 11, wherein the another rigid layer has another edge having a linear shape extending in the first direction.

14. The liquid ejecting head according to claim 11, wherein the rigid layer and the another rigid layer are made of metal.

15. The liquid ejecting head according to claim 14, wherein the metal is selected from the group consisting of gold, iridium, aluminum, and platinum.

16. The liquid ejecting head according to claim 11, wherein the rigid layer and the another rigid layer are made of electrically insulating material.

17. The liquid ejecting head according to claim 16, wherein the electrically insulating material is selected from the group consisting of SiN, $SiO_2$ and $Al_2O_3$.

18. The liquid ejecting head according to claim 1, wherein the first electrode is an individual electrode, and wherein the second electrode is a common electrode.

* * * * *